US006363687B1

(12) United States Patent
Luciano et al.

(10) Patent No.: US 6,363,687 B1
(45) Date of Patent: Apr. 2, 2002

(54) SECURED CELL, RAPID FILL AUTOMATED TABLET ORDER FILLING SYSTEM

(75) Inventors: Robert A. Luciano, Tewksbury Township, Hunterdon County; Lawrence W. Luciano, Clinton Township, Hunterdon County, both of NJ (US); Richard L. Smith, Coventry Township, Chester County, PA (US)

(73) Assignee: Luciano Packaging Technologies, Inc., Somerville, NJ (US)

( * ) Notice: Subject to any disclaimer, the term of this patent is extended or adjusted under 35 U.S.C. 154(b) by 0 days.

(21) Appl. No.: 09/519,196

(22) Filed: Mar. 6, 2000

(51) Int. Cl.[7] ..... B65B 57/00

(52) U.S. Cl. ..... 53/55; 53/493; 53/495; 53/900; 53/131.2

(58) Field of Search ..... 53/501, 55, 168, 53/437, 411, 131.2, 493, 900, 495; 414/740, 739

(56) References Cited

U.S. PATENT DOCUMENTS

| | | | | |
|---|---|---|---|---|
| 3,871,295 A | | 3/1975 | Ackley | 101/426 |
| 3,889,591 A | | 6/1975 | Noguchi | 101/37 |
| 3,925,960 A | | 12/1975 | Saari et al. | 53/78 |
| 4,231,462 A | | 11/1980 | Ackley, Sr. et al. | 198/380 |
| 4,377,971 A | | 3/1983 | Ackley | 101/40 |
| 4,394,933 A | | 7/1983 | Ackley | 221/173 |
| 4,582,201 A | | 4/1986 | Taniguchi et al. | 209/587 |
| 4,619,360 A | | 10/1986 | Taniguchi et al. | 198/471.1 |
| 5,208,762 A | * | 5/1993 | Charhut et al. | |
| 5,240,118 A | | 8/1993 | Mayer | 209/539 |
| 5,463,839 A | | 11/1995 | Strange et al. | 53/54 |
| 5,771,657 A | * | 6/1998 | Lasher et al. | |
| 5,963,453 A | * | 10/1999 | East | |
| 6,256,967 B1 | * | 7/2001 | Hebron et al. | |

OTHER PUBLICATIONS

ScriptoPro SP200 Robotic Dispensing System.*

* cited by examiner

*Primary Examiner*—Eugene Kim
(74) *Attorney, Agent, or Firm*—Kenneth P. Glynn

(57) ABSTRACT

The present invention tablet filler device system includes a plurality of individually secured cells with a tablet hopper and drum functionally adapted to regulate and orient gravity outflow of tablets, a gravity feed chute connected to and downstream from the hopper to singularly align and feed tablets, and a rotatable starwheel having slots to receive tablets from the feed chute to move tablets to a container filling substation. There is also a tablet inspection mechanism located on the feed chute to discern quality characteristics of tablets moving down the feed chute in accordance with a predetermined standard, and a tablet ejector to eject unacceptable tablets. A stepper drive motor with a counter capability for driving the starwheel in a step fashion for controlled release of tablets is included, and an optional counting verification sensor. The cells are interconnected for computer controlled automatic order filling for a variety of tablet types and container sizes.

29 Claims, 8 Drawing Sheets

SECURED CELL, RAPID FILL AUTOMATED TABLET ORDER FILLING SYSTEM

BACKGROUND OF THE INVENTION

1. Field of the Invention

The present invention relates to tablet filler cells having high security and unique functional features, and systems with multiple cells having individual cell security and master computer control for rapid, accurate individual prescription filling with enhanced quality control features. The cells include, for example, tablet filler devices with a starwheel for filling, which relies upon a stepper, tablet counting motor, tablet inspection mechanisms, unacceptable tablet ejection, counting confirmation sensors and closed system filling stations. These systems have high speed qualities, ultra-high security, isolation of each different type of tablet from each other, quality control redundancies and fool-proof aspects at the filling and labelling stations.

2. Information Disclosure Statement

Tablet dispensing is accomplished on a small scale basis at the local level closest to the end user—namely, at pharmacies, dispensaries, clinics and other medical services related facilities. At this level, simple, manual, dispensing devices are employed, such as "lazy susan" type rotating dispensers with columns containing different types of pharmaceuticals or rows of dispenser columns containing different types of pharmaceuticals. In these environments, the multi-pharmaceutical manual dispenser is typically maintained in some sort of locked fashion, such as in a cabinet or in a secured dispensing room. At the other end of the spectrum, mega quantities of tablets are filled and distributed by pharmaceutical manufacturers. Massive filling equipment is employed in government regulated "clean rooms" or "clean buildings" and macro security in the form of locked rooms and employee ID programs are utilized.

Recently, a company called "ScriptPro" has developed a prescription fulfillment system for community ambulatory and managed care pharmacies. This has been designed for the local level with a robotic prescription dispensing system which handles 200 or so different types of tablet or capsules and fills and labels up to 90 prescriptions per hour. This is described in ScriptPro LLC's 1998–99 Catalog No. 3000-0000.001, entitled, "Robotic Prescription Dispensing System" and available at http://www.scriptpro.com/catalog.

The ScriptPro SP 200 system described in the above has been developed to handle different types of tablets in a single system and operated at a maximum of 90 prescriptions per hour. On the other hand, the present invention system has been developed for regional level prescription fulfillment such as may be handled by mail order prescription firms and internet firms and similar vitamin firms, etc. Unlike ScriptPro, the present invention system can fulfill 5000 to 6000 prescriptions per hour and relies upon separate filler cells for each different type of tablet and/or bottle size. Further, the present invention system operates in a totally different manner with different subsystem components.

The particular tablet filler units utilized in the individually secured cells and the multi-cell system of the present invention could be any available commercial tablet filler which is computer controllable and affords quality control features. However, the preferred embodiments are the ones that have extremely high speed fulfillment utilizing the starwheel tablet filler devices described in more detail below.

The following patents are representative of the state of the art of filler devices:

U.S. Pat. No. 3,871,295 describes a capsule orienting and turning apparatus and method for use in a spin printing procedure in which a printing roll moves at a greater speed than the capsule, thus causing the capsule to rotate about its own axis while it is being printed. Many capsules, randomly arranged in a hopper, are picked up in a rotary conveyor which arranges them first in vertical arrangement relative to the path of movement of the conveyor, some capsules upright and some inverted, and an air jet shifts the body portions of the upright capsules in the machine direction so that the cap portions can subsequently be shifted in a sideways direction by a subsequent sideward-directed air jet. Those capsules which are inverted are not affected by the first air jet because of a barrier which prevents their movement; the cap portions of these inverted capsules are blown sideways by the sidewardly directed air stream. In this way, the positions of the capsules are rectified, with all of the cap portions on one side of the predetermined path and all of the body portions on the other side of the predetermined path.

U.S. Pat. No. 3,889,591 describes a branding machine for automatically printing indicia on tablets, pills, candies or any other products of any similar shape and/or size, which comprises a hopper unit, a feed unit including at least one rotary drum having the periphery formed with a plurality of radially inwardly recessed receptacles arranged in at least one row and a printer unit. The receptacles are successively communicated with a vacuum source for receiving the products therein under suction at first, then with a source of compressed air for posture correction of said products within the associated receptacles, again with the vacuum source for holding the posture-corrected products in a definite posture thereby to enable them to be printed by the printing unit, and finally with the compressed air source for successively ejecting the printed products on to a subsequent processing station. A method for reproduction of the indicia on the products.

U.S. Pat. No. 3,925,960 describes a machine for filling containers with discrete articles comprising a series of elongated slat members movable in a closed path, a portion of the slat members having an outer surface with a multiplicity of spaced apart cavities therein. The path comprises spaced apart cavity charging and discharging stations. Means at the charging station deposit articles in the cavities. The slat outer surfaces tilt at the discharge station for the simultaneous discharging of articles. Container delivery means continuously feed containers at a predetermined uniform speed along a line parallel to the direction of elongation of the slat members and below the level of slat members at the discharge station. A first set of stationary article-guiding chutes is disposed in side-by-side relation at said discharge station, each chute having an upper inlet and tapering to a narrowed outlet. A second set of chutes is supported for movement in a closed path, each chute being generally vertically disposed and having an upper inlet wider in the direction of chute travel than any first set chute outlet and a lower outlet smaller than its inlet. The closed chute path includes a portion extending the full length of the slat members with chutes in that path portion aligned with the container feeding line and the first set chute outlets. Drive means are provided for driving the container delivery means, for driving the chutes such that each chute moves with its outlet aligned with a moving container, and for driving the slat members.

U.S. Pat. No. 4,231,462 describes a turning and orienting apparatus of the type adapted to transport capsules in a plurality of pockets or the like, which pockets are formed in a continuously moveable transport conveyor, and wherein said apparatus is further adapted to rectify the capsules, which have body portions and cap portions of greater transverse dimensions than the body portions, and wherein a vacuum is provided to shift the capsules into the desired rectified position, a capsule portioning guide is provided to retain each capsule in its pocket immediately prior to its being subject to the vacuum. The capsule positioning guide then releases the capsule as it subjected to the vacuum. In a preferred embodiment of the invention, the capsule position is pivotally mounted adjacent the capsule transport conveyor so that it can be easily moved out of its operative condition adjacent the transport conveyor for easy cleaning thereof.

U.S. Pat. No. 4,377,971 describes an apparatus which is disclosed which transports and rectifies objects, such as pharmaceutical capsules, and prints appropriate indicia on the objects. The apparatus comprises a two-drum system, the first drum being used to shift objects from a radial to a longitudinal position, and then to reorient some of the capsule so that, when the capsules are delivered to a second drum, the cam drum, all capsules are pointing in the same direction. The system takes advantage of gravity for rectification. Spin printing means are provided to print indicia on the rectified objects, as the objects travel along the periphery of the cam drum. A process for operating the apparatus is disclosed.

U.S. Pat. No. 4,394,933 describes a capsule orienting apparatus in which misoriented asymmetric capsule inadvertently passed by a rectifying unit are segregated from properly oriented capsules. Capsules are delivered by a rectifying drum to capsules carrying pockets in a segregating drum which have recessed portions sized to loosely receive properly oriented capsules and tightly receive misoriented capsules. As the loosely held, properly oriented capsules pass a discharge point, they are released. The tightly held, misoriented capsules remain in the segregating drum past the discharge point and are ejected from the segregating drum downstream from the discharge point.

U.S. Pat. No. 4,582,201 describes a product transporting apparatus for transporting solid products of generally similar shape and/or size successively from a take-in station towards a take-out station, which has first and second rotary drums rotatable in the opposite directions to each other. The first and second rotary drums are of identical construction each having at least one circumferentially row of tubular receptacles protruding radially outwardly from the outer periphery of the respective drum and circumferentially equally spaced from each other. The products can be successively supplied onto the first rotary drum and held by suction in position on the tubular receptacles then communicated with a vacuum source at the take-in station, which are in turn transported, during the rotation of the drums, to the transfer station where they are released from the receptacles on the first drum then communicated with a compressed air source, onto the respective tubular receptacles on the drum then communicated with the vacuum source. The products so transferred onto the secondary drum are then transported in a similar fashion towards the take-out station where they are successively released from the second rotary drum onto a subsequent processing station.

U.S. Pat. No. 4,619,360 describes a product transporting apparatus for transporting solid products of generally similar shape and/or size successively from a take-in station towards a take-out station, which comprises first and second rotary drum rotatable in the opposite directions with each other. The first and second rotary drums are of identical construction each having at least one circumferential row of tubular receptacles protruding radially outwardly from the other periphery of the respective drum and circumferentially equally spaced from each other. The products can be successively supplied onto the first rotary drum and held in position sucked by the tubular receptacles then communicated with a vacuum source at the take-in station, which are in turn transported, during the rotation of the drums, to the transfer station where they are released from the receptacles on the first drum then communicated with a compressed air source, onto the respective tubular receptacles on the second rotary drum then communicated with the vacuum source. The products so transferred onto the second rotary drum are then transported in a similar fashion towards the take-out station where they are successively released from the second rotary drum onto a subsequent processing station.

U.S. Pat. No. 5,240,118 describes an apparatus for feeding tablets in an aligned and uniformly oriented sequence onto a tablet measuring device, including a moveable turntable having a deflector for guiding the tablets to a circumferential edge, a guide member and plow assembly respectively aligned in parallel and spaced apart relationship, the guide member having longitudinally-spaced air jets and the plow assembly having respective edge surfaces for slidably guiding tablets to a uniform orientation, and including a gate for removing particles and broken tablets from the channel to prevent them from being conveyed onto the measuring system.

U.S. Pat. No. 5,463,839 describes an apparatus for packaging a pre determined quantity of objects and a counting device therefore is disclosed. The counting device includes a feed chute for singularizing objects, and the tray has at least one guide path including segments defining a direction of movement oriented at an angle with respect to the drive axis of the tray. The packaging apparatus includes the counting device and associated components and controls for the automatic, high speed filling of containers.

Notwithstanding the prior art, the present invention is neither taught nor rendered obvious thereby.

SUMMARY OF THE INVENTION

The present invention is directed to a rapid fill automated tablet order filling system. In its simplest embodiment, it is a single secured cell system with a master security enclosure having solid walls and an access door with a locking mechanism, having an inlet for feeding empty bottles and having an outlet for removing filled, capped bottles; a conveyor means for conveying bottles through said inlet of said master security enclosure and through a plurality of operation stations within said master security enclosure and through said outlet; a first operation station being a tablet filling station having a tablet hopper arrangement consisting of at least one hopper with all of said at least one hopper being for a single type of tablet, said tablet filling station including at least one tablet filler, said hopper arrangement being connected to said at least one tablet filler, said at least one tablet filler having an egress located above said bottle conveyor means; a second operation station being an automated cap feeder located downstream from said tablet filler along said conveyance means for applying a secured cap to a bottle after it has been filled; a computer control system including a central computer and its controllers, at least one controller being connected to said conveyance means, at least one controller being connected to said tablet hopper arrangement and at least one controller being connected to said cap feeder, said computer control system central computer and controllers being interconnected and said central computer having sufficient software to be programmable and adapted to control coordinated operation of said conveyor means and all of said operation stations so as to sequentially move a plurality of bottles through said inlet, fill said bottles with a predetermined number of tablets and cap said bottles and subsequently move said bottles through said outlet. In some embodiments of the single secured system, there is also included a third operation station which is a cottoner device for filling bottles with an impact-protection batt of material after said bottles are filled with tablets, said cottoner device being located between said first operation station and said second operation station and being functionally connected to said computer control system. In yet other embodiments of the single secured cell system, there is a fourth operation station which is a bottle printer having means to apply predetermined indicia to bottles passing therethrough, i.e. printed labels which are adhered to the bottles, or printing directly on the bottles, or both.

In other embodiments, the present invention is directed to a rapid fill automated tablet order filling system with a plurality of individually secured cells, with each cell having the features described above, as well as a master conveyor means, and order verification means, a marking or a print and label application means, as well as a master computer control. The master conveyor means is connected to the individual conveyor means of each of the plurality of secured cells, the master conveyor means being connected to the conveyor means of the individual cells downstream from each outlet of the individual cells for accumulation of all tablet-filled bottles exiting the individual cells for order consolidation. The order verification means is located at the master conveyance means (downstream from the individually secured cells) and the print and label application means is also located at the master conveyance means downstream from the order verification means.

The present invention individually secured cell system and the present invention multi-cell system include at least one tablet filler device. Such devices may be any which will function within the context of the cells and are computer controllable, but preferred tablet filler devices are those using starwheels and are the subject of a separate patent application and have been developed by the present inventors herein.

Thus, the present invention preferred embodiment systems include a tablet filler device with enhanced quality control features. In one preferred embodiment, it includes a tablet hopper for filling with randomly positioned tablets of a predetermined size and shape. The tablet hopper has a base with an outlet for gravity outflow of tablets and has an agitating drum functionally connected to the outlet for regulation and orientation of gravity outflow of tablets from the hopper. There is also a feed chute connected to and downstream from the hopper for receiving tablets therefrom. The feed chute is arranged so as to singularly align and feed tablets in a fixed orientation by gravity feed, i.e. lines them up in a single row. The feed chute is sufficiently non-horizontal to permit gravity flow of tablets therethrough. At the lower end of the feed chute is a rotatable starwheel having a plurality of slots adapted to receive the tablets individually from the feed chute so as to move tablets from the feed chute to a filling outlet for gravity feed to a container filling substation located below the filling outlet. The container filling substation is located below the filling outlet of the starwheel.

Additionally, there is a tablet inspection means located on the feed chute with sufficient discrimination capabilities to discern quality characteristics of tablets moving down the feed chute in accordance with a predetermined standard. The standard may be broken tablets, sizes of tablets, shape of tablets, color or other characteristics, and is likely a combination of two or more of these characteristics. The tablet inspection means includes means to identify unacceptable tablets and to communicate with a tablet ejector for ejection of the unacceptable tablets. The tablet ejector is adapted to eject unacceptable tablets from the feed chute in response to signals from the tablet inspection means. There is also stepper drive motor with a counter means for driving the starwheel in a step fashion for controlled release of tablets via the filling outlet and for counting tablets released from the filling outlet.

In some preferred embodiments, the tablet filler device also includes a controller computer connected to the stepper motor to start and stop the motor to operate the starwheel so as to fill a container with a predetermined number of tablets. Also, the tablet inspection means preferably includes a camera and a computer connected to both the camera and the tablet ejector the computer may be the same as the controller computer for the step up motor, separate from it, but contains sufficient software to receive feedback data from the camera, compare the feedback data from the camera with predetermined standards, and recognize each tablet inspected which does not meet the predetermined standards as unacceptable by sending ejection signals to the tablet ejector so as to activate and eject each unacceptable tablet.

In some other preferred embodiments, the container filling substation includes a closed staging chamber connected to the filling outlet of the starwheel for hold up of released tablets until a predetermined number of tablets have been released to fill a container. This staging chamber has a shutter base adapted to open and close in coordination with positioning thereunder of sequential containers to be filled, coupled with attainment of the required predetermined number of tablets to fill a container. Thus, the container filling substation includes a diving nozzle for insertion into and extraction from necks of containers to be filled so as to prevent any tablets from exiting or dropping out between the starwheel and the container. In other words, the closed staging chamber and a nozzle, especially a diving nozzle, prevents any opportunity for tablet loss between the starwheel with counter, and the container. The container filling substation may also include tablet count verification sensors: one sensor on the starwheel and a second sensor below the starwheel or, as an alternative, a single sensor below the starwheel to compare and confirm the tablet count, e.g. electric eyes, motion sensors or other sensors.

Since containers may be moved into the filling station with unique identifiers, e.g. on pucks or other holders with unique indicia, the container filling substation may include an RF reader or other unique identifying means for identifying and tracking each container as it proceeds through the container filling substation.

In yet other preferred embodiments of the present invention, the tablet filler device may have a plurality of feed chutes connected to the hopper. In some cases there will be separate starwheels, tablet inspection means, ejectors, filling stations, etc. for each of the plurality of feed chutes. In other cases, the tablet filler device includes a plurality of feed chutes connected to one another to form a single end feed chute upstream from the tablet inspection means and these and other components are arranged only once sequentially for a single filling station. In some preferred embodiments, individual pucks (holders) are used to hold individual containers:

containers can be of varying heights, but variations in the puck construction allow for a constant height neck finish on containers above conveyor; hence, no changeovers requested for different sizes of containers.

pucks can contain RF chips that can be activated for identification; hence, no labels required.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1A:
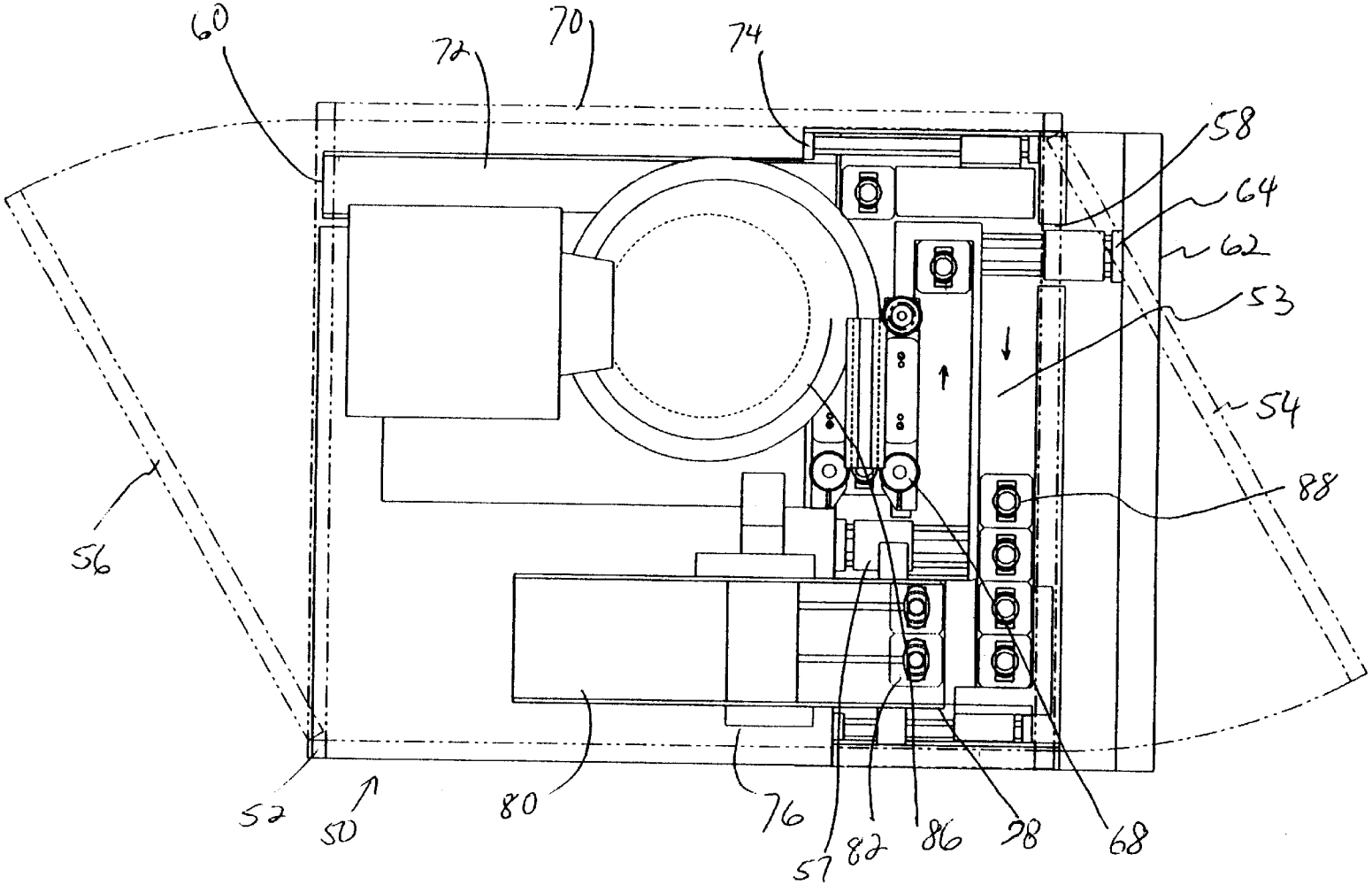
FIGS. 1*a*, 1*b* and 1*c* illustrate top, side and front diagrammatic views of one embodiment of a secured cell of the present invention.
Figure 1C:
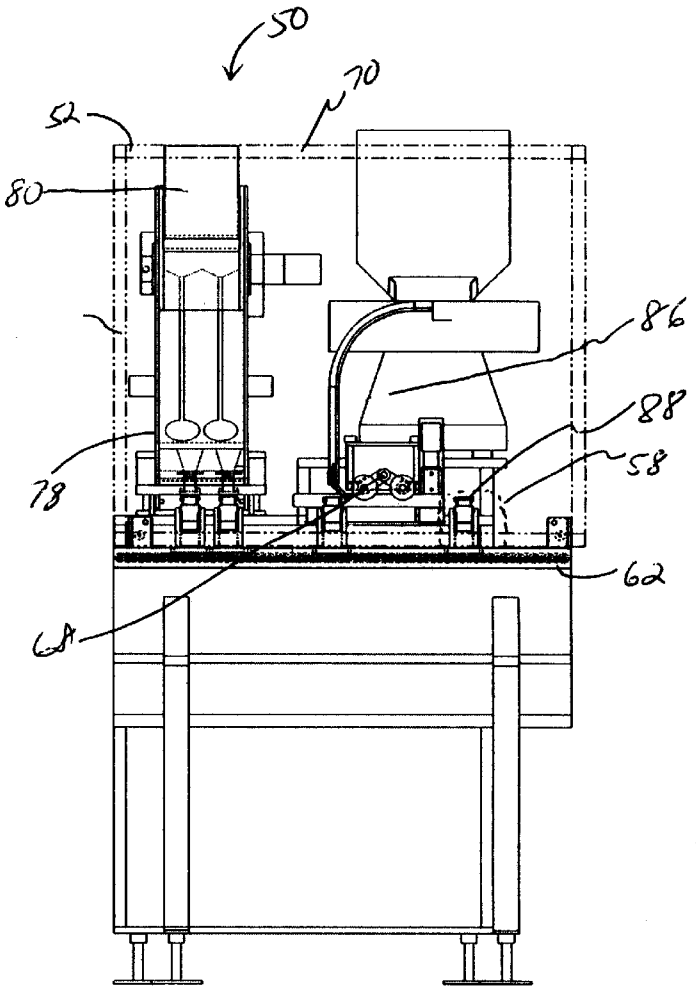
Figure 1B:
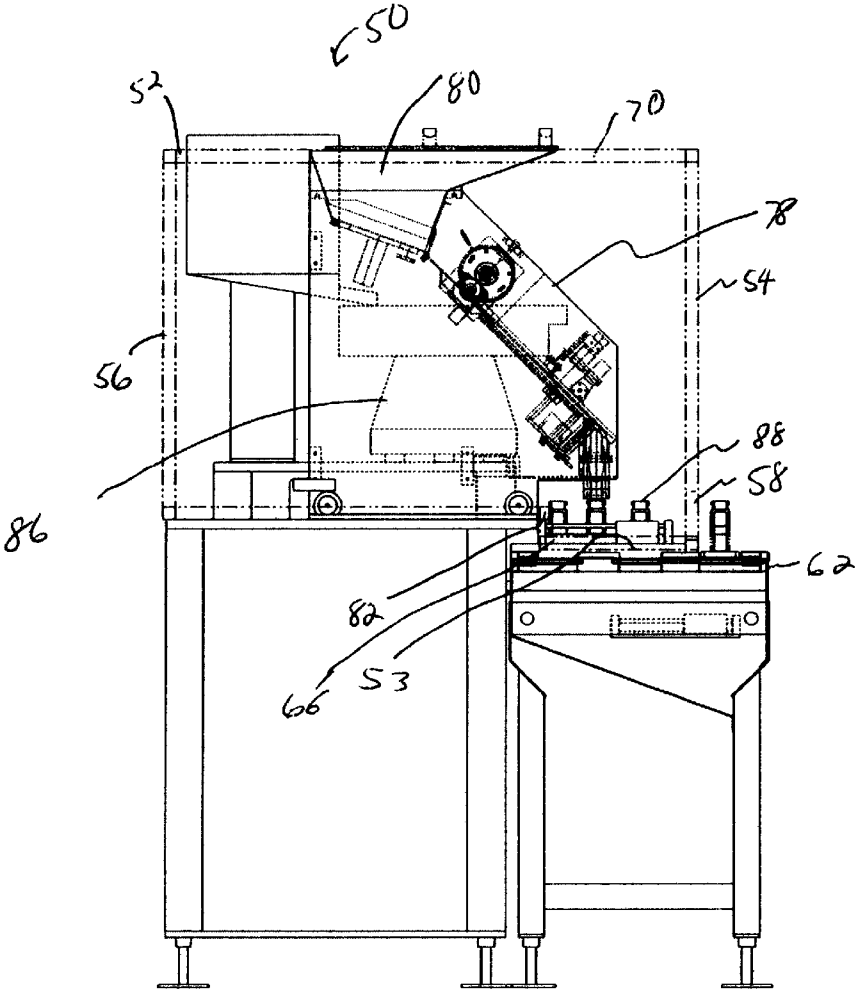

FIGS. 1*a*, 1*b* and 1*c* show top, side and front views of one embodiment of a present invention secured single cell system for rapid fill automated tablet order filling. In all of FIGS. 1*a*, 1*b* and 1*c*, identical parts are identically numbered. The Figures show individually secured cell system 50 having an enclosure 52 which is lockable and prevents unauthorized use or intrusion and deters pharmaceutical theft. Security enclosure 52 has walls such as wall 70 and has lockable doors 54 and 56, as shown. Door 56 includes an inlet 58 for movement of empty containers into security enclosure cell 52 and has an outlet 60 for outflow of filled containers.

The conveyor system of individually secured cell system 50 involves two separate conveyors (one of which has multiple lanes) and bottle transfer mechanisms. The conveyors are preferably roller bed conveyors which permit lost or dropped tablets to pass through without being accidentally moved to another station or cell, thereby further increasing quality control. Infeed conveyor 62 moves empty bottles in carrier pucks through inlet 58. Bottle transfer, computer controlled push arms such as push arm 64 moves the empty bottles from infeed conveyor outside lane 62 through inlet 58, onto filler queue lane 53 inside enclosure 52.onto indexing conveyor 66. By computer control, the empty containers such as container 88, once they have been moved into correct position they will be held below tablet filler device 78 for controlled filling. A radio frequency reader such as reader 82 will identify each individual container with unique identifiers. located on carrier pucks. Tablet filler 78, in this case a dual head filler, has a single tablet hopper 80 and is thus structured to handle only one type of tablet, fills each container in accordance with computer directed signals. The bottles then advance along conveyor 66 and an optional cottoner may insert impact protection cotton into the container to secure the tablets. The containers then advance to cap feeder 86 where they are capped and sealed. Roller placer 68 aligns the containers and advances them to optional printer. This function may be located within security enclosure 52 or outside and downstream therefrom and is controlled by computer to match the printed mark to the particular prescription or order being filled. After the bottles have been capped, they advance to push arms such as push arm 74 which moves the completed bottles to outlet conveyor 72. In the event of a rejected bottle, rejected bottles will be diverted to lane 55. The bottle can be rejected for several reasons:

improper tablet fill;

RF tag incorrectly programmed;

marking incorrectly applied; or, cap incorrectly applied.

The system contains sensors to detect each condition which are controlled through the central computer. If any of these sensors detect a reject condition, push transfer 57 activates and the bottle proceeds to lane 50. The entire process is computer controlled with high speed operation. By avoiding multiple size container and/or multiple types of tablets, there is no mix up in the filling process and the process itself is operated at 10 to 50 times faster than currently available systems.

While the present invention system shown in FIGS. 1*a*, 1*b* and 1*c* utilizes a dual head filler, a single head, a triple head or other type of filler device may be employed in the alternative. In its simplest form, a single head filler is utilized and this and a preferred single head filler which may be substituted for tablet filler 78 in FIGS. 1*a*, 1*b* and 1*c* are described in great detail in conjunction with FIGS. 2 and 3 below. Additionally, to increase ease of operation, a support base 76 for the tablet filler 78 and single tablet hopper 80, and other options as desired is included and this may be a roll out device shown in its rolled out position as base 76'.

Figures 2, 3:
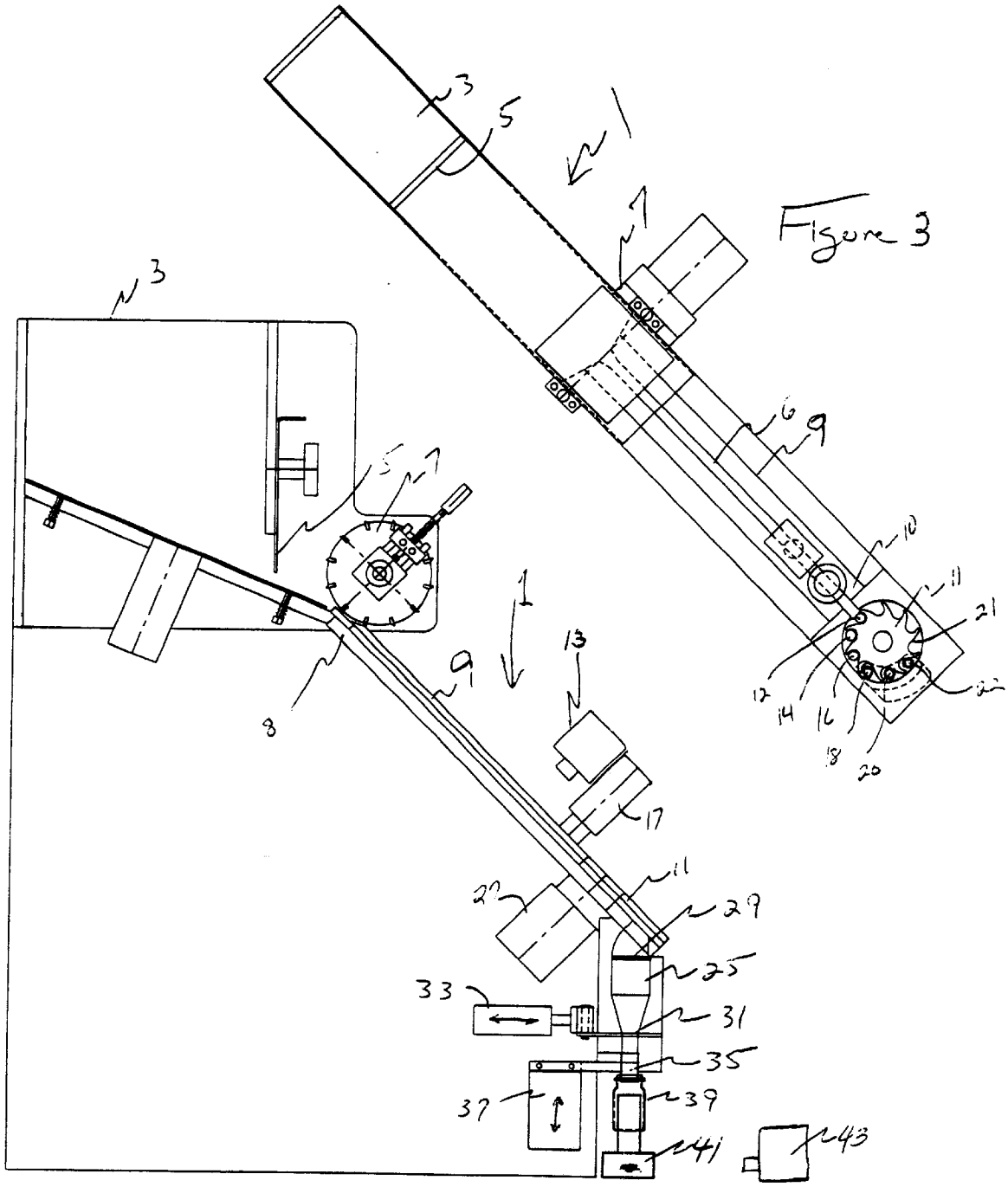
FIG. 2 shows a side view and FIG. 3 shows a partial top view of a single feed chute, quality control enhanced tablet filler device used in a present invention secured cell.

Referring to FIGS. 2 and 3, there is shown a side view and a partial top view of a high quality control tablet filler device 1 which may be used in the present invention cells. It includes a tablet supply hopper 3 with an adjustable exit gate 5 and rotating drum 7 for unitary release of tablets in an oriented fashion. The drum 7 is functionally connected to hopper 3, as shown. Gravity feed chute 9 with channel 16 is connected at its upper end 8 to hopper 3 and drum 7 and at its lower end 10 to rotatable starwheel 11. Upstream from rotatable starwheel 11 is a tablet inspection means, in this case a camera 13 connected to communicating computer described below which instructs (activates) ejector 17 to eject an unacceptable tablet. This is determined by data from the camera for each tablet passing by with predetermined quality characteristics. Those which do not meet the characteristics designated are deemed unacceptable and are ejected (e.g. by vacuum or catch and movement). This is a critical quality control feature of the present invention device and system, and may be based on any recognizable characteristic or combination thereof desired, e.g. color, shape, composition, fracture, printed code, etc. Alternatively, the camera ejector may be located above the starwheel and, therefore in some embodiments, inspection and ejection will take place at the starwheel. Additionally, the inspection means such as the camera mentioned above may include surge assurance features, i.e., sensing that tablets continue to feed and stack the chute. This could also be done with a separate device, e.g. with optical fiber(s).

Figure 4:
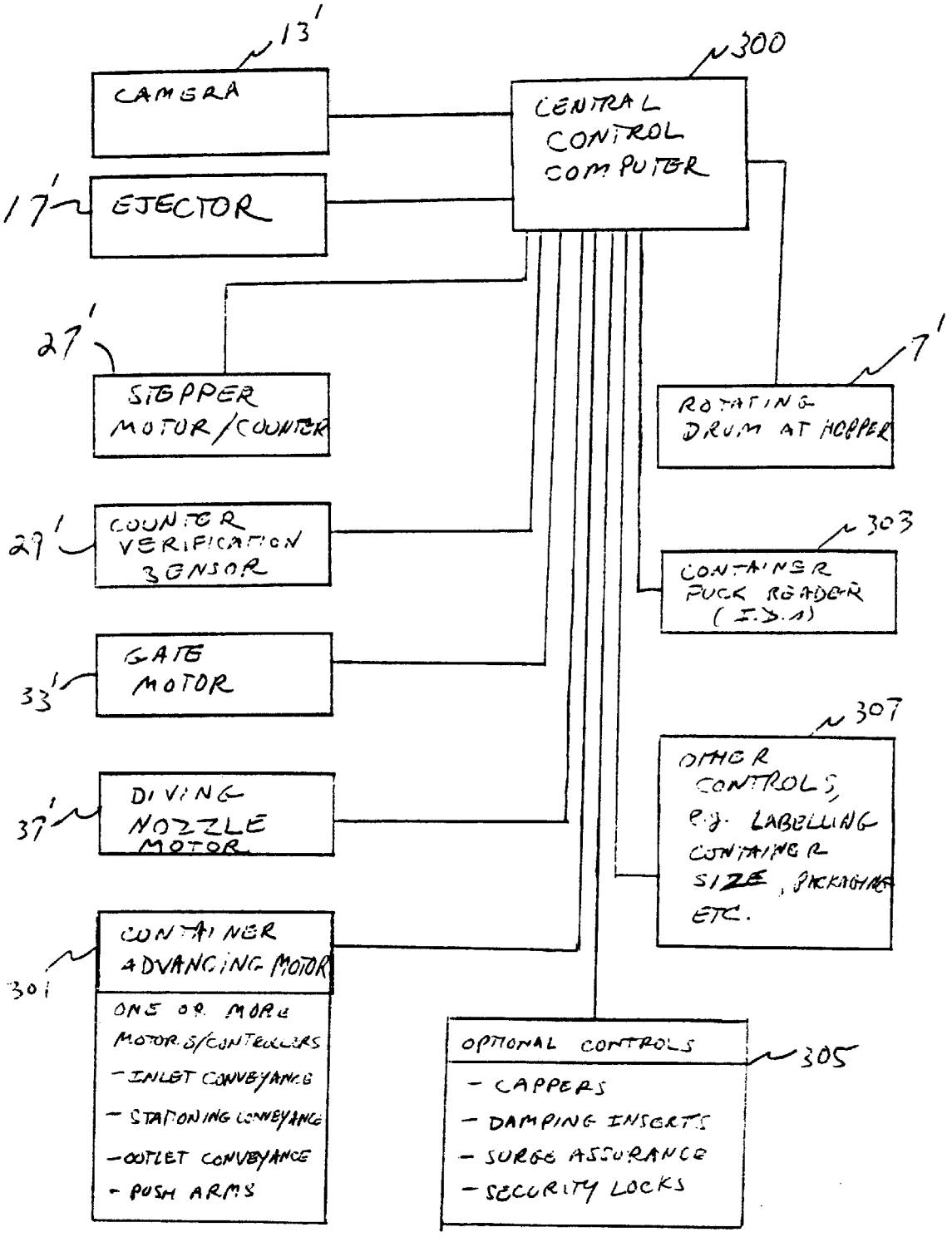
FIG. 4 shows a block diagram of the computer control aspects for a single secured cell of the present invention.

Gravity feed chute 9 is in a non-horizontal position to permit gravity flow of tablets to rotating starwheel 11 with tablet receiving catch protrusions such as catch protrusion 21. Thus, in FIG. 3 tablet 12 is shown entering rotating starwheel 11 and tablets 14, 16, 18 and 20 are rotating counterclockwise but could alternatively be clockwise. Tablet 22 is dropping through an orifice under rotating starwheel 11 into closed staging chamber 25 (FIG. 2). There is also a stepper motor 27 which moves in a step-wise fashion to stop, pick up a tablet, move forward to the next position, stop, pick up another tablet, etc. Alternatively, and in some preferred embodiments, the starwheel is designed and coordinated with tablet flow to permit continuous operation. Stepper motor 27 acts not only to control and operate starwheel 11, but also operates as a counter of tablets with feedback to a computer (FIG. 4). Tablets such as tablet 22 drop by gravity into staging chamber 25 and an option count verification sensor 29 keeps an independent count of the descending tablets and verifies the count by stepper motor 27.

In this embodiment, there is a shutter base or gate 31 which operates for fill escapement by gate motor 33. Thus, starwheel 11 will stop and gate motor 33 will open gate 31 when staging chamber 25 reaches a predetermined count level of tablets to fill a container, determined by the counter feature of stepper motor 27 and verified by the counter verification sensor 29 and there is a counter for filling positioned below. (In some embodiments, a container confirming sensor may be included which would prevent the gate from opening when no container is present.) Once the tablets in staging chamber 25 have descended into the container 39 below, gate 31 will close and starwheel 11 will commence.

Also, in this embodiment is a diving nozzle 35 controlled by actuator 37. Thus, diving nozzle 35 is positioned downwardly by actuator 37 when an empty container such as container 39 is to be filled and is being filled. When container 39 is filled and gate 31 is closed, diving nozzle 35 is moved to its up position and a new container is moved to the filling area below diving nozzle 35. It is not always necessary or preferable to include sequential filling or diving nozzles. Thus, sometimes it is more reliable to put tablets into a bottle in a "single tablet stream", since this prevents bridging and tablets hanging up in the fill nozzle or bottle neck. It is a function of the size of the tablet in relation to the size of the neck opening.

Additionally, containers such as container 39 may be mounted or held by a holder or puck such as puck 41 which may have unique identifiers. For example, each puck may have a unique bar code or unique RF tag and would be read by a sensor such as a bar code scanner or RF reader 43 for identifying and tracking each container as it passes through each filling area.

FIG. 4 shows a block diagram for one embodiment of a computer control system of the present invention and each block which relates to a component shown in FIG. 1, and/or FIG. 2 and/or FIG. 3, has identifying numbers followed by a prime. Thus, central control computer 300 is connected to all of the above identified components as shown in FIG. 4 to uniquely control and coordinate and harmonize all of the features described above. As shown, included is a container advancing motor conveyance feature 301 controlled by central control computer 300 to synchronize its operation with inlet conveyance, stationing conveyance, inspection, ejection, starwheel counter, counter verification, other station operations and outlet conveyance. A container puck reader 303 would provide identifying information for each container to the computer 300 for tracking, labelling, quality control and other purposes. Optional controls 305 for cappers, clamping insert insertion devices, e.g. cottoners, additional surge assurance sensors and coordination, and even security locks for the cells, may be included. Finally, block 307 represents other controls which may be controlled with the central computer such as labeling, container size and filler quantity changes, grouping and packaging automated systems and even tablet size, dosage or type of tablet changes.

Figure 5:
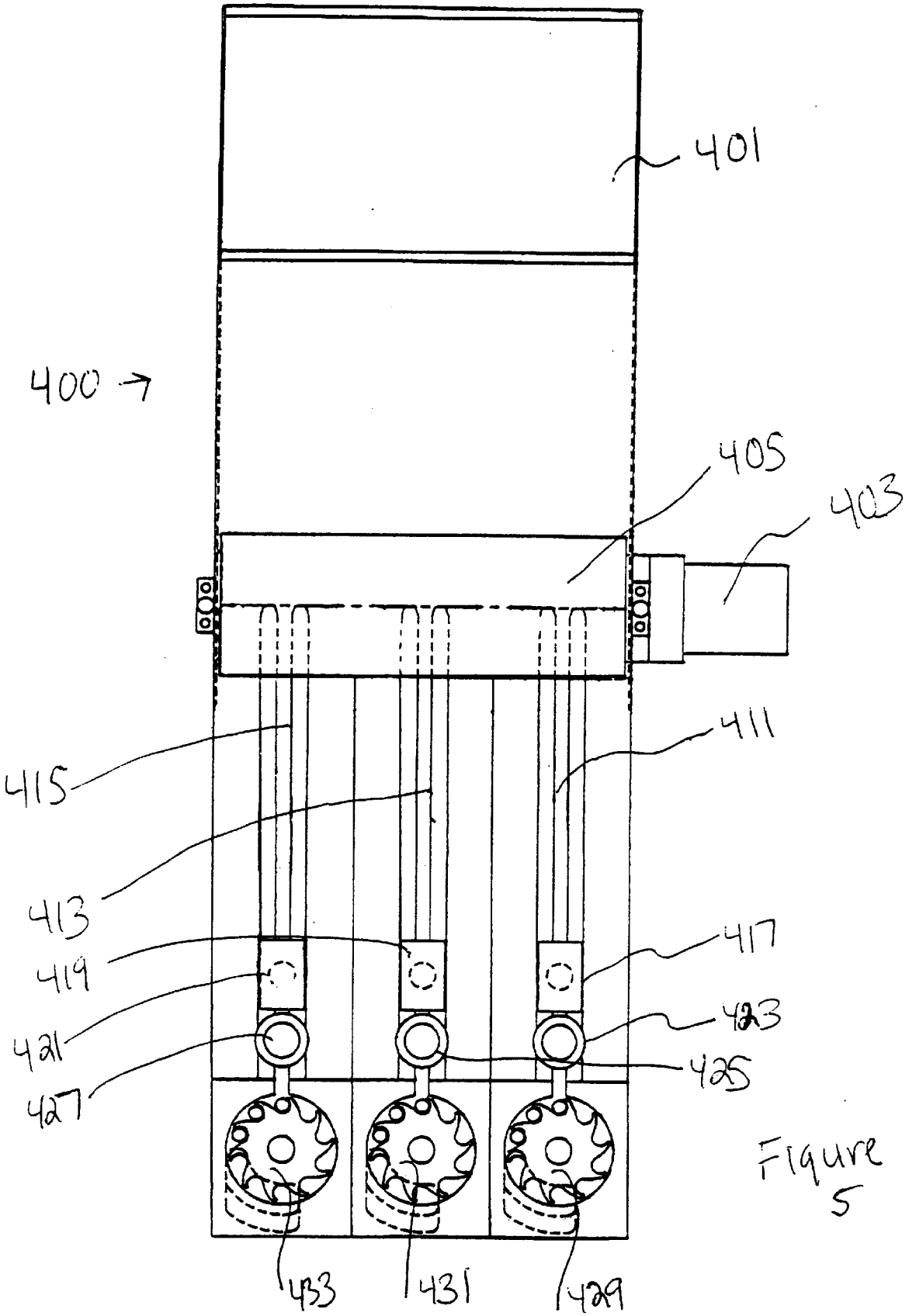
FIG. 5 shows a top view of details of another tablet filler device having a single hopper and plural parallel feed chutes and includes details of the container filling substation and container rejection mechanisms.

FIG. 5 shows a present invention embodiment top view tablet filling device 400 having a single hopper 401 but with multiple gravity feed chutes. Thus, gravity device 400 includes a drive motor 403 and one drum 405. There are three gravity feed chutes 411, 413, and 415; three inspection devices 417, 419 and 421; three ejectors 423, 425 and 427; and, three starwheels 429, 431, and 433 with a separate motor for each starwheel which is independently controlled. (Other aspect such as filling station 401 may be included, but are not shown). Using device 400, a single hopper may have triple the filling capabilities on a per hour or per day basis by virtue of filling three containers side-by-side simultaneously.

Figure 6:
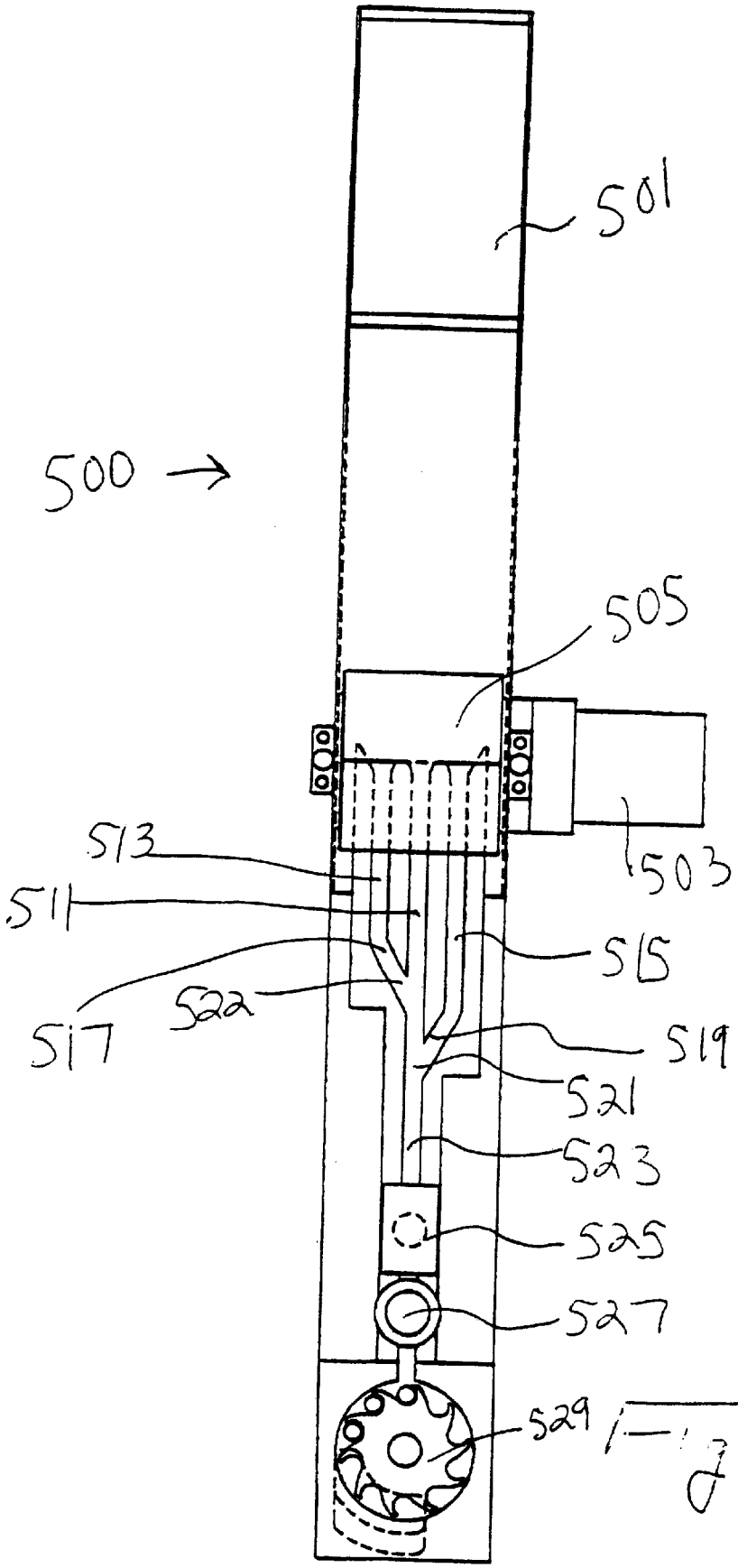
FIG. 6 shows a front view of alternative embodiment tablet filler device plural feed chute arrangements which may be used in the present invention secured cells.

FIG. 6 shows a top view of present invention high quality control tablet filler device 500 having a single hopper 501 and here having a manifolding system is utilized to guarantee that the gravity feed chute always provides a full line of tablets. Thus, there is a drum 505, driven by motor 503 and three upper gravity feed chutes 511, 513 and 515. However, in this device 500, the individual upper gravity feed chutes 511, 513 and 515 converge to central chute 511 via traversals 517 and 519 in a manifolding fashion to junctions 521 and 522, whereafter all incoming tablets ultimately flow down single lower feed chute 523. Since the convergence occurs upstream from the inspections, ejections, counting, etc., only a single inspecting mechanism 525 and ejecting mechanism 527 is required. (Alternatively, three separate inspecting and ejecting means could be utilized upstream from junction 521.) Likewise, a single starwheel 529 and filling station (not shown) similar to FIGS. 1 and 2 would be utilized.

Figure 7:
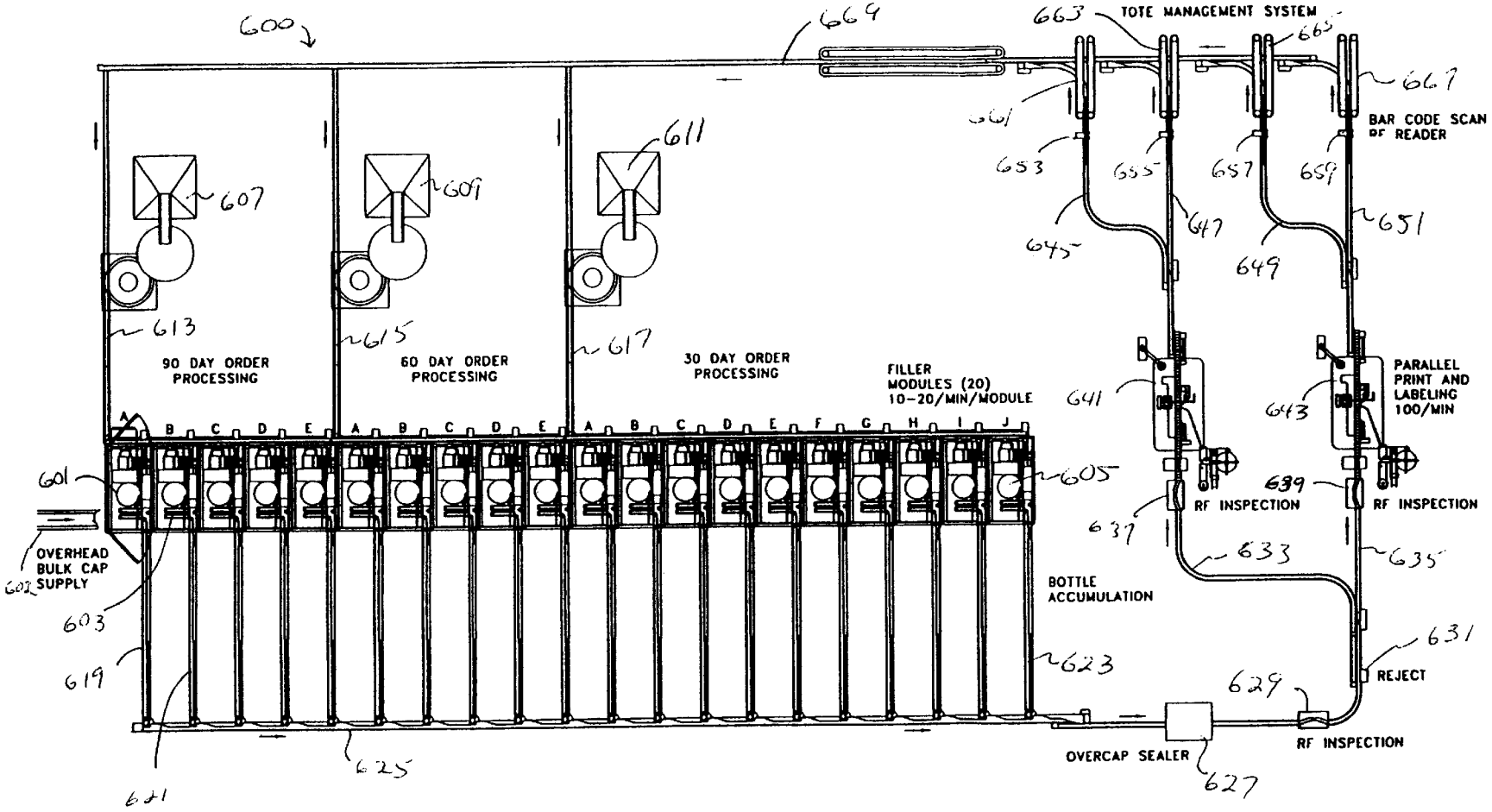
FIG. 7 illustrates a top view of one embodiment of the present invention complete system utilizing multiple, individually secured cells; and, FIG. 8 shows a block diagram of the master computer control aspects for a multiple, individually secured cell system.

FIG. 7 shows a top view of a diagrammatic representation of a complete present invention system 600 utilizing multiple, individually secured cells. Cells 601, 603, etc. through end cell 605 each have various present invention components and stations as described herein above for the individual cells. In this case, there is a total system encompassing a floor area of approximately 36 feet by 70 feet and capable of processing a tremendous number of various orders, i.e. unique, customized orders for an assemblage of different size tablets, containers, dosages and types of tablets. Each cell, such as cell 601, has a plurality of puck carriers entering the inlet for various operations for tablet filling and then exiting the cells for further handling, inspecting, labelling and shipping. In this particular embodiment, there is a puck carrier return system which cycles the pucks in continuous loops, picking up new containers for processing. Thus, incoming pucks on puck lines 613, 615 and 617 receive containers from container supply devices 607, 609 and 611, respectively. Each of these devices may include container unscramblers, cleaners, desiccant fillers as well as mechanical loading of containers onto the pucks. For example, these devices may each be able to handle three or more different size bottles and may operate, for example, at 100 loaded pucks per minute per machine. The pucks and containers may have unique identifiers such as bar code information or radio frequency information or otherwise, and may be re-coded with each cycle. The pucks with containers (bottles) move from station to station, with overhead bulk cap supply 602 providing all the cells with sufficient caps, within the individual cells and then stack up on the outlet side of the cells along lines 619, 621 all the way across to line 623 at the end. These all connect to an order release conveyor 625 for automatic order consolidation. Downstream, there is an overcap sealer 627 and a radio frequency inspection station 629. By computer, if the RF inspection station results are negative (do not match the intended order) rejection is effected at rejection station 631. Otherwise, the filled and sealed containers travel along either track 633 or 635 and at RF inspection confirmation stations 637 and 639 are rematched to particular orders with label printing and label applications for individual orders occurring at label stations 641 and 643, respectively. These operate in parallel at 100 per minute per machine. The label containers then move along traffic controlled tracks 645, 647, 649 or 651 for removal from the pucks. After again being identified by readers 653, 655, 657 and 659 they are depucked through depucking belts 661, 663, 665 and 667, after which the completed orders enter the tote management system for shipping. The pucks then return for another cycle via return line 669.

There is a central computer which would control the individual stations in each of the cells would also control the overall system. Thus, most or all functions may be controlled by computer or the central computer may be used to act primarily as a traffic controller. For example, in one preferred embodiment a computer control is not required for the upper, cottoner, printer or the initiation of the filler cycle. All operations will be performed in accordance to the status of an incoming "surge assurance" sensor in front of each device and/or the status of a "backup limit" sensor at the exit of each device. These sensors would be tied into a dedicated, small PLC for each individual cell.

In some preferred embodiments of the present invention, the pucks or puck carriers may be designed to achieve the following:

take a variety of different height bottles.

The pucks are to be of different internal dimensions for each different size bottle to present a common, constant height neck finish for each size bottle when in the pucks.

Provide an external and internal design near the top of each puck, regardless of the size bottle contained, that will allow the bottle to be labelled in the same place, regardless of bottle size.

Each bottle size would be the same diameter.

Pucks would be designed with parallel straight sides at bottom to allow for non-turning traverse through conveyor system.

Pucks to contain RF tag with "pullout/failsafe" feature.

Using pucks with the above features allows the entire packaging line to operate on any product/size bottle with no change parts except tablet handling parts.

It can now be seen that by the above invention, in its various embodiments, that a more mechanically simplified, yet quality control sophisticated tablet filler device cells and plural cell systems have been provided that has not heretofore been developed in the industry.

Figure 8:
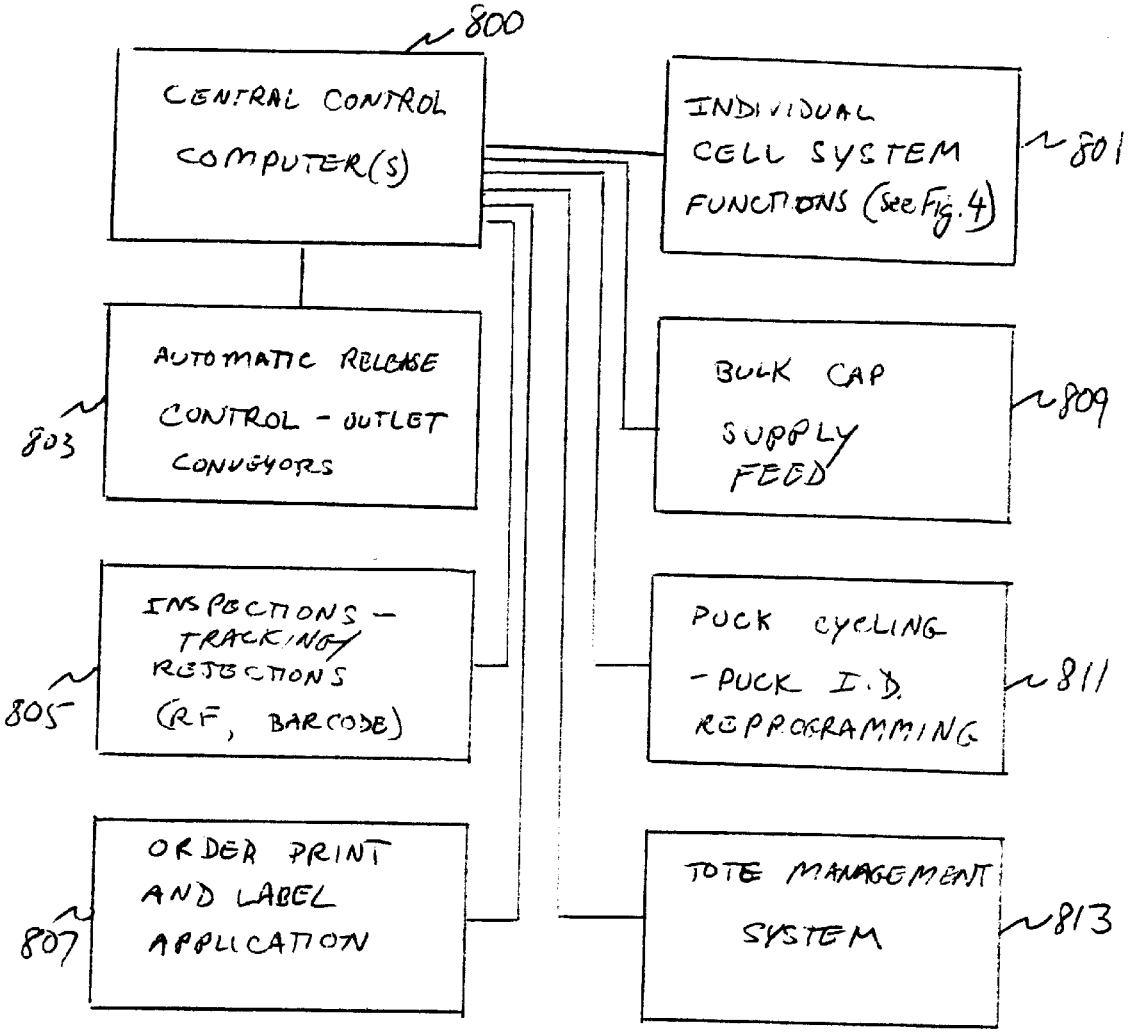

FIG. 8 shows a simplified schematic diagram of one possible embodiment of computer control computer(s) 800 may include all or many of the individual cell system functions 801. These are individual cell system functions 801. These are detailed in FIG. 4 above. Additionally, there is automatic release control 803 or outlet conveyors to the main conveyor for proper sequencing of containers in services consistent with automatic total order filling. Likewise inspections 805 for both tracking and rejections may be computer followed and controlled. Order printing and label applying 807 may be handled by the central control computer(s) 800 directly or through links with order taking or fulfillment centers. Likewise, bulk cap supply feed 809 may be coordinated by computer, as will be puck carrier cycling 811, for puck carrier tracking, recycling and even changing puck i.d. by RF reprogramming. Finally, disposition of containers to fill specific orders into the tote management system 813 may be computer controlled, tracked, confirmed and stored.

In one preferred embodiment, the computer includes means for programming the RF tag immediately as the container is being filled, specifically identifying the type of tablet. This programming will remain until either;

the container is removed from the puck for any reason; or

The finished, labeled container is removed from the system during normal operation.

Obviously, numerous modifications and variations of the present invention are possible in light of the above teachings. For example, the reference to a central control computer herein may be taken to mean a single computer connected to all aspects of the invention or a plurality of computers performing collectively the same functions as a single computer. It is,therefore understood that within the scope of the appended claims, the invention may be practiced otherwise than as specifically described herein.

What is claimed is:

1. A secured multi-cell, rapid fill automated tablet order filling system which comprises:

I.] A plurality of individually secured cells, each cell having:

(a) a master security enclosure having solid walls and an access door with a locking mechanism, having an inlet for feeding empty bottles and having an outlet for removing filled, capped bottles;

(b) conveyor means for conveying bottles through said inlet of said master security enclosure and through a plurality of operation stations within said master security enclosure and through said outlet;

(c) a first operation station being a tablet filling station having a tablet hopper arrangement consisting of at least one hopper with all of said at least one hopper being for a single type of tablet for a single type of tablet, said tablet filling station including at least one tablet filler, said hopper arrangement being connected to said at least one tablet filler, said at least one tablet filler having an egress located above said bottle conveyor means;

(d) a second operation station being an automated cap feeder located downstream from said tablet filler along said conveyance means for applying a secured cap to a bottle after it has been filled;

(e) a plurality of controllers, at least one controller being connected to said conveyance means, at least one controller being connected to said tablet hopper arrangement and at least one controller being connected to said cap feeder;

II.] a master conveyor means connected to the individual conveyor means of each of said plurality of secured cells, said master conveyor means being connected to said conveyor means of said individual cells downstream from each outlet of said individual cells for accumulation of all tablet-filled bottles exiting said individual cells for order consolidation;

III.] an order verification means located at said master conveyance means;

IV.] a print and label application means located downstream from said order verification means on said master conveyance means; and, V.] a master computer control system having a central computer which is interconnected with said plurality of controllers, said central computer having sufficient software to be programmable and being functionally connected and adapted to control coordinated operation each of said plurality of individually secured cells, and said individually secured cell conveyor means and all of said controllers and all of said operation stations, and said master conveyor means so as to sequentially move a plurality of bottles through said each inlet of each individually secured cell, fill said bottles with a predetermined number of tablets and cap said bottles and subsequently move said bottles through the outlet of each individually secured cell, said master computer control system also having sufficient software and being functionally connected to said order verification means and said print and label application means so as to identify each bottle from each of said plurality of individually secured cell, to match each said bottle to an order, to verify the match of the order and to print an appropriate order label and apply it to each said bottle.

2. The secured multi-cell, rapid fill automated tablet order filling system of claim 1 wherein each of said individually secured cells of said system further includes:

(f) a third operation station being a clamping insert insertion device for filling bottles with an impact-protection clamping insert after said bottles are filled with tablets, said device being located between said first operation station and said second operation station and being functionally connected to said computer control system.

3. The secured multi-cell, rapid fill automated tablet order filling system of claim 1 wherein each of said individually secured cells of said system, further includes:

(g) a fourth operation station being a bottle printer having means to apply predetermined indicia to bottles passing therethrough.

4. The secured multi-cell, rapid fill automated tablet order filling system of claim 1 wherein each of said individually secured cell conveyor means includes a first conveyor at said inlet, a second conveyor continuous to said first conveyor and running from said first conveyor, past said tablet filler and past said cap feeder, and a third conveyor contiguous to said second conveyor and passing through said outlet.

5. The secured multi-cell, rapid fill automated tablet order filling system of claim 4 wherein each of said individually secured cell first conveyor and said second conveyor are at least in part next to each other in an off-set manner relative to direction of travel and a bottle transfer device is located adjacent said first conveyor to move bottles from said first conveyor to said second conveyor.

6. The secured multi-cell, rapid fill automated tablet order filling system of claim 5 wherein each of said individually secured cell second conveyor and said third conveyor are at least in part next to each other in an off-set manner relative to direction of travel and a bottle transfer device is located adjacent said first conveyor to move bottles from said second conveyor to said third conveyor.

7. The secured multi-cell, rapid fill automated tablet order filling system of claim 1 wherein each of said individually secured cell tablet filling station includes:

(i) a tablet hopper for filling with randomly positioned tablets of a predetermined size and shape, said tablet hopper having a base with an outlet for gravity outflow of tablets;

(ii) an agitating drum functionally connected to said outlet and adapted to regulate and orient gravity outflow of tablets from said hopper;

(iii) a feed chute connected to and downstream from said hopper for receiving tablets therefrom and adapted to singularly align and feed tablets in a fixed orientation by gravity feed, said feed chute being sufficiently non-horizontal to permit gravity flow of tablets therethrough;

(iv) a rotatable starwheel having a plurality of slots adapted to receive tablets individually from said feed chute so as to move tablets from said feed chute to a filling outlet for gravity feed to a container filling substation located below said filling outlet;

(v) a container filling substation located below said filling outlet of said starwheel;

(vi) tablet inspection means located on at least one of said feed chute or said rotatable starwheel and having sufficient discrimination capabilities to discern quality characteristics of tablets moving down said feed chute in accordance with a predetermined standard including means to identify unacceptable tablets and communicate with a tablet ejector for ejection of unacceptable tablets;

(vii) a tablet ejector in communication with said tablet inspection means adapted to eject unacceptable tablets from said feed chute in response to signals from said tablet inspection means; and, (viii) a stepper drive motor with a counter means for driving said starwheel in a step fashion for controlled release of tablets via said filling outlet and for counting tablets released from said filling outlet of said starwheel.

8. The secured multi-cell, rapid fill automated tablet order filling system of claim 1 wherein said central computer of said computer control system is connected to said stepper motor of each of said individually secured cells to start and stop said motor to operate said starwheel so as to fill a container with a predetermined number of tablets.

9. The secured multi-cell, rapid fill automated tablet order filling system of claim 7 wherein said tablet inspection means includes a camera and a computer connected to both said camera and said tablet ejector, said computer containing sufficient software to receive feedback data from said camera, compare feedback data from said camera with predetermined standards, recognize each tablet inspected which does not meet said predetermined standards as unacceptable by sending ejection signals to said tablet ejector so as to activate and eject each unacceptable tablet.

10. The secured multi-cell, rapid fill automated tablet order filling system of claim 7 wherein each of said individually secured cell container filling substation includes:

a closed staging chamber connected to said filling outlet of said starwheel for hold up of released tablets until a predetermined number of tablets have been released to fill a container, said staging chamber having a shutter base adapted to open and close in coordination with positioning thereunder of sequential containers to be filled.

11. The secured multi-cell, rapid fill automated tablet order filling system of claim 7 wherein said container filling substation includes a tablet count verification sensor.

12. The secured multi-cell, rapid fill automated tablet order filling system of claim 7 wherein each of said individually secured cell container filling substation includes a diving nozzle for insertion into and extraction from necks of containers to be filled.

13. The secured multi-cell, rapid fill automated tablet order filling system of claim 7 wherein each of said individually secured cell container filling substation includes an RF reader for identifying and tracking each container as it proceeds through said container filling substation.

14. The secured multi-cell, rapid fill automated tablet order filling system of claim 1 wherein, in each of said individually secured cells, there is a plurality of feed chutes connected to said hopper.

15. The secured multi-cell, rapid fill automated tablet order filling system of claim 14 wherein for each of said plurality of feed chutes there are separate items (d) through (h).

16. The secured multi-cell, rapid fill automated tablet order filling system of claim 1 which further comprises:

VI.] a plurality of bottle receiving puck carriers adapted to receive and hold individual bottles prior to entering said individually secured cells and adapted to operate within said conveyance means of each individually secured cell and to operate within said master conveyance means;

VII.] a closed loop puck carrier return system having means to separate finished bottles at a downstream end of said master conveyance means and having return means to return said puck carriers to a starting position upstream from said individually secured cells for receiving new bottles and passing through said system in a cyclical fashion.

17. The secured multi-cell, rapid fill automated tablet order filling system of claim 16 wherein each puck carrier has a unique identification indicator thereon and said system includes readers located at least at each of said individually secured cells and at said order verification means, said readers being functionally connected to said master central computer system to identify and track each bottle within the system and to match each bottle to an order for proper printing and labelling.

18. The secured multi-cell, rapid fill automated tablet order filling system of claim 16 wherein said puck carrier return system includes at least one pre-bottle filling, pre-individually secured cell preparation station having an unscrambler, a cleaner, a desiccant filler and a puck loader.

19. The secured multi-cell, rapid fill automated tablet order filling system of claim 16 wherein said puck carrier return system includes a plurality of pre-bottle filling, pre-individually secured cell preparation stations having an unscrambler, a cleaner, a desiccant filler and a puck loader.

20. A secured multi-cell, rapid fill automated tablet order filling system which comprises:

(a) a master security enclosure having solid walls and an access door with a locking mechanism, having an inlet for feeding empty bottles and having an outlet for removing filled, capped bottles;

(b) conveyor means for conveying bottles through said inlet of said master security enclosure and through a plurality of operation stations within said master security enclosure and through said outlet;

(c) a first operation station being a tablet filling station having a tablet hopper arrangement consisting of at least one hopper with all of said at least one hopper being for a single type of tablet for a single type of tablet, said tablet filling station including at least one tablet filler, said hopper arrangement being connected to said at least one tablet filler, said at least one from said feed chute so as to move tablets from said feed chute to a filling outlet for gravity feed to a container filling substation located below said filling outlet;

(i) a tablet hopper for filling with randomly positioned tablets of a predetermined size and shape, said tablet hopper having a base with an outlet for gravity outflow of tablets;

(ii) an agitating drum functionally connected to said outlet and adapted to regulate and orient gravity outflow of tablets from said hopper;

(iii) a feed chute connected to and downstream from said hopper for receiving tablets therefrom and adapted to singularly align and feed tablets in a fixed orientation by gravity feed, said feed chute being sufficiently non-horizontal to permit gravity flow of tablets therethrough;

(iv) a rotatable starwheel having a plurality of slots adapted to receive tablets individually response to signals from said tablet inspection means; and, (v) a container filling substation located below said filling outlet of said starwheel;

(vi) tablet inspection means located on at least on of said feed chute or said rotatable starwheel and having sufficient discrimination capabilities to discern quality characteristics of tablets moving down said feed chute in accordance with a predetermined standard including means to identify unacceptable tablets and communicate with a tablet ejector for ejection of unacceptable tablets;

(vii) a tablet ejector in communication with said tablet inspection means adapted to eject unacceptable tablets from said feed chute in tablet filler having an egress located above said bottle conveyor means, said tablet filling station including:

(viii) a stepper drive motor with a counter means for driving said starwheel in a step fashion for controlled release of tablets via said filing outlet and for counting tablets released from said filling outlet of said starwheel;

(d) a second operation station being an automated cap feeder located downstream from said tablet filler along said conveyance means for applying a secured cap to a bottle after it has been filled;

(e) a computer control system including a central computer and its controllers, at least one controller being connected to said conveyance means, at least one controller being connected to said tablet hopper arrangement and at least one controller being connected to said cap feeder, said computer control system central computer and controllers being interconnected and said central computer having sufficient software to be programmable and adapted to control coordinated operation of said conveyor means and all of said operation stations so as to sequentially move a plurality of bottles through said inlet, fill said bottles with a predetermined number of tablets and cap said bottles and subsequently move said bottles through said outlet.

21. The secured multi-cell, rapid fill automated tablet order filling system of claim 20 wherein said system further comprises:

(f) a third operation station being a clamping inset insertion device for filling bottles with an impact-protection clamping insert after said bottles are filled with tablets, said device being located between said first operation station and said second operation station and being functionally connected to said computer control system.

22. The secured multi-cell, rapid fill automated tablet order filling system of claim 20 wherein said system further comprises:

(g) a fourth operation station being a bottle printer having means to apply predetermined indicia to bottles passing therethrough.

23. The secured multi-cell, rapid fill automated tablet order filling system of claim 20 wherein said conveyor means includes a first conveyor at said inlet, a second conveyor continuous to said first conveyor and running from said first conveyor, past said tablet filler and past said cap feeder, and a third conveyor contiguous to said second conveyor and passing through said outlet.

24. The secured multi-cell, rapid fill automated tablet order filling system of claim 23 wherein said first conveyor and said second conveyor are at least in part next to each other in an off-set manner relative to direction of travel and a bottle transfer device is located adjacent said first conveyor to move bottles from said first conveyor to said second conveyor.

25. The secured multi-cell, rapid fill automated tablet order filling system of claim 24 wherein said second conveyor and said third conveyor are at least in part next to each other in an off-set manner relative to direction of travel and a bottle transfer device is located adjacent to said first conveyor to move bottles from said second conveyor to said third conveyor.

26. The secured multi-cell, rapid fill automated tablet order filling system of claim 20 wherein said central computer of said computer control system is connected to said stepper motor to start and stop said motor to operate said starwheel so as to fill a container with a predetermined number of tablets.

27. The secured multi-cell, rapid fill automated tablet order filling system of claim 20 wherein said tablet inspection means includes a camera and a computer connected to both said camera and said tablet ejector, said computer containing sufficient software to receive feedback data from said camera, compare feedback data from said camera with predetermined standards, recognize each tablet inspected which does not meet said predetermined standards as unacceptable by sending ejection signals to said tablet ejector so as to activate and eject each unacceptable tablet.

28. The secured multi-cell, rapid fill automated tablet order filling system of claim 20 wherein said container filling substation includes:

a closed staging chamber connected to said filling outlet of said starwheel for hold up of released tablets until a predetermined number of tablets have been released to fill a container, said staging chamber having a shutter base adapted to open and close in coordination with positioning thereunder of sequential containers to be filled.

29. The secured multi-cell, rapid fill automated tablet order filling system of claim 20 wherein said container filling substation includes a tablet count verification sensor.

* * * * *